US008727025B2

(12) United States Patent
Anderson

(10) Patent No.: US 8,727,025 B2
(45) Date of Patent: May 20, 2014

(54) DOWNHOLE TOOL SEAL ARRANGEMENT AND METHOD OF SEALING A DOWNHOLE TUBULAR

(75) Inventor: Gary L. Anderson, Humble, TX (US)

(73) Assignee: Baker Hughes Incorporated, Houston, TX (US)

( * ) Notice: Subject to any disclaimer, the term of this patent is extended or adjusted under 35 U.S.C. 154(b) by 626 days.

(21) Appl. No.: 12/881,713

(22) Filed: Sep. 14, 2010

(65) Prior Publication Data

US 2012/0061104 A1 Mar. 15, 2012

(51) Int. Cl.
*E21B 33/12* (2006.01)
*E21B 23/06* (2006.01)
*E21B 33/128* (2006.01)

(52) U.S. Cl.
USPC ..... 166/386; 166/121; 166/120; 166/193

(58) Field of Classification Search
USPC ..... 166/120, 121, 134, 192, 193, 387, 191, 166/386
See application file for complete search history.

(56) References Cited

U.S. PATENT DOCUMENTS 2,178,844 A * 11/1939 Baker ..... 166/142
3,098,525 A * 7/1963 Haeber ..... 166/348
3,414,069 A * 12/1968 Kammerer, Jr. ..... 175/268
3,587,736 A 6/1971 Brown
3,687,202 A * 8/1972 Young et al. ..... 166/305.1
3,924,678 A * 12/1975 Ahlstone ..... 166/120
4,153,108 A 5/1979 Pounds et al.
4,237,979 A 12/1980 Weise
4,285,400 A * 8/1981 Mullins, II ..... 166/179
4,285,402 A 8/1981 Brieger
4,289,202 A * 9/1981 Henderson ..... 166/212
4,314,608 A 2/1982 Richardson
4,374,543 A 2/1983 Richardson
4,390,065 A 6/1983 Richardson
4,396,066 A * 8/1983 Akkerman et al. ..... 166/387
4,424,864 A 1/1984 Logan
4,510,995 A 4/1985 Krause, Jr. et al.
4,532,989 A 8/1985 Barker
4,576,236 A 3/1986 Stout et al.
4,624,308 A * 11/1986 White ..... 166/65.1
4,637,468 A 1/1987 Derrick
4,881,598 A * 11/1989 Stockinger et al. ..... 166/250.08

(Continued)

FOREIGN PATENT DOCUMENTS

CA 2455543 * 7/2005

OTHER PUBLICATIONS

Notification of Transmittal of the International Search Report and the Written Opinion of the International Searching Authority, or the Declaration; PCT/US2011/043031; Feb. 24, 2012.

(Continued)

*Primary Examiner* — Kenneth L Thompson
(74) *Attorney, Agent, or Firm* — Cantor Colburn LLP

(57) ABSTRACT

A downhole tool includes, a body having a recess, a first seal bore, a second seal bore, and a tool disposed at the body that is responsive to differential pressure across a piston. The downhole tool is configured to allow a differential pressure to form across the piston in response to a first plug sealing to and located at the first seal bore by the recess and preventive of forming a pressure differential across the piston in response to a second plug sealing to and located at the second seal bore by the recess.

14 Claims, 1 Drawing Sheet

(56) References Cited

U.S. PATENT DOCUMENTS

| | | | | |
|---|---|---|---|---|
| 4,903,777 | A * | 2/1990 | Jordan et al. | 166/387 |
| 4,928,761 | A | 5/1990 | Gazda et al. | |
| 4,951,746 | A * | 8/1990 | Setterberg, Jr. | 166/114 |
| 5,117,910 | A | 6/1992 | Brandell et al. | |
| 5,186,258 | A | 2/1993 | Wood et al. | |
| 5,277,253 | A | 1/1994 | Giroux et al. | |
| 5,318,117 | A | 6/1994 | Echols, III et al. | |
| 5,330,000 | A | 7/1994 | Givens et al. | |
| 7,111,677 | B2 | 9/2006 | St. Clair | |
| 7,654,334 | B2 * | 2/2010 | Manson | 166/387 |
| 7,681,651 | B2 | 3/2010 | Loughlin | |
| 7,878,256 | B2 * | 2/2011 | Slack | 166/386 |
| 8,136,588 | B2 * | 3/2012 | Manson | 166/216 |
| 8,302,692 | B2 * | 11/2012 | Ravensbergen | 166/316 |
| 2007/0204986 | A1 | 9/2007 | Sorhus | |
| 2007/0295507 | A1 * | 12/2007 | Telfer et al. | 166/302 |
| 2008/0169105 | A1 * | 7/2008 | Williamson et al. | 166/374 |

OTHER PUBLICATIONS

Omar A. Abou-Sayed et al., "Development of a Through-Flow-Line (TFL)-Deployed Insert Surface-Controlled Subsurface Safety Valve"; Society of Petroleum Engineers, Paper No. SPE 62956, Oct. 1, 2000.

I.C. Chapman et al., "Wireline Deployed Metal Sealing Bridge Plug System: Operational Learning Curve and Subsequent Redevelopment"; Society of Petroleum Engineers, Paper No. SPE 113891, Apr. 1, 2008.

* cited by examiner

DOWNHOLE TOOL SEAL ARRANGEMENT AND METHOD OF SEALING A DOWNHOLE TUBULAR

BACKGROUND

Tubular systems typically employ tools that actuate in response to hydraulic pressure being applied to a piston. Elastomeric seals, such as o-rings disposed at the pistons, for example, allow the pistons to move in relation to a housing while maintaining seals therebetween. After actuation of the tool the elastomeric seals have, by design, completed their task and will not be required to hold differential pressure thereacross. In some situations, however, subsequent borehole activity may cause a differential pressure to exist across the seals. This situation may occur when plugging a portion of a wellbore to prevent production therefrom in an application directed to hydrocarbon recovery, for example. Continued differential pressure across the elastomeric seals places higher functional and structural demands on the seals. Systems and methods to avoid placing these additional demands on the seals would therefore be well received in the art.

BRIEF DESCRIPTION

Disclosed herein is a downhole tool. The downhole tool includes, a body having a recess, a first seal bore, a second seal bore, and a tool disposed at the body that is responsive to differential pressure across a piston. The downhole tool is configured to allow a differential pressure to form across the piston in response to a first plug sealing to and located at the first seal bore by the recess and preventive of forming a pressure differential across the piston in response to a second plug sealing to and located at the second seal bore by the recess.

Further disclosed herein is a method of sealing a downhole tool. The method includes, positioning a first plug with a recess of the downhole tool, sealably engaging a first seal bore with the first plug, pressuring up against the first plug, and building a pressure differential across a piston of the downhole tool. The method further includes, removing the first plug from engagement with the downhole tool, positioning a second plug with the recess, sealably engaging a second seal bore with the second plug, and preventing building of a pressure differential across the piston.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
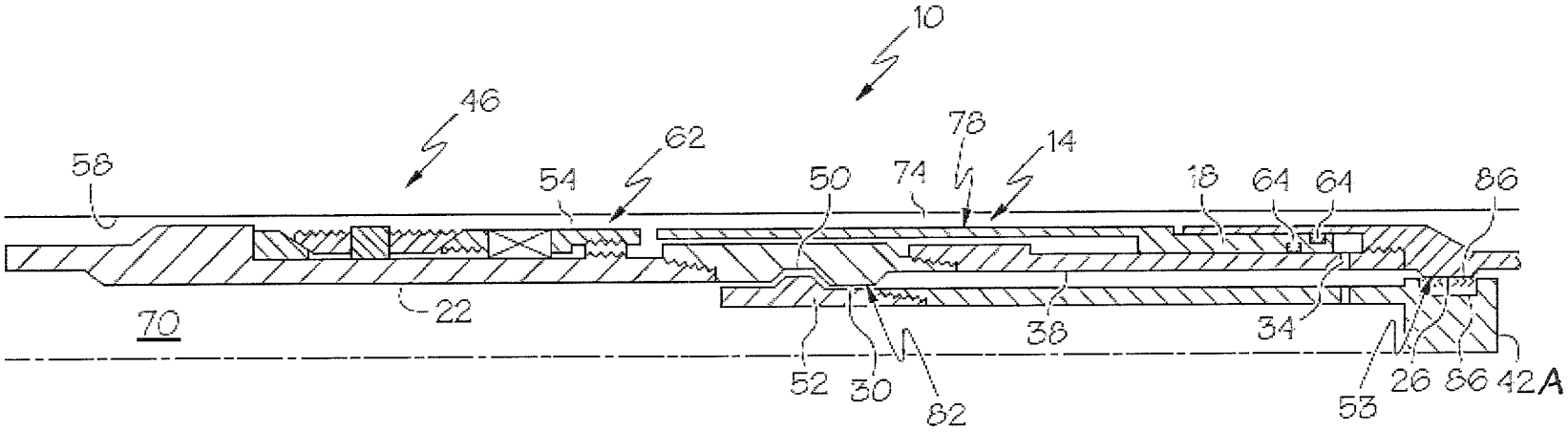
FIG. 1 depicts a partial cross sectional view of a downhole tool seal arrangement disclosed herein.

Referring to FIG. 1, an embodiment of a downhole tool sealing arrangement disclosed herein is illustrated generally at 10. The downhole tool sealing arrangement 10 includes, a setting tool 14 that is responsive to hydraulic pressure acting upon a piston 18. A tubular 22 has a first seal bore 26 and a second seal bore 30 that longitudinally straddle one or more openings 34, with a single opening being illustrated in this embodiment, through a wall 38 thereof. The seal bores 26, 30 are sealingly receptive to one or more plugs 42 runnable within the tubular 22. The first seal bore 26 is positioned downstream of the opening 34 while the second seal bore 30 is positioned upstream of the opening 34. A packer 46, illustrated in this embodiment, positioned uphole of the setting tool 14 and the opening 34, is settable by movement of the piston 18 in an uphole direction.

The foregoing structure is operated by first running one of the plugs 42 into sealing engagement with the first seal bore 26. One or more recesses 50 (with just one recess being illustrated herein) in the tubular 22 can be engaged by a collet 52 (Note: dogs or other engagement devices could also be employed in place of or in addition to the collet) of the plug 42 to positionally locate the plug 42 in sealing engagement with a surface 53 of the first seal bore 26. Hydraulic pressure can then build against the plug 42, in this case from the uphole direction, and pressurize the piston 18 through the opening 34. The piston 18 then moves in an upward direction and engages a ring 54 of the packer 46 and sets the packer 46 into sealing and anchoring engagement with a borehole 58, casing, or other downhole structure. A ratchet arrangement 62 can be employed to maintain the packer 46 in the set position even after pressure on the setting tool 14 has been reduced.

The existence of the second seal bore 30 and the positioning of the second seal bore 30, specifically the second seal bore 30 being located uphole of the first seal bore 26 and the opening 34, provides benefits over typical systems. Typical systems employ only the first seal bore 26 and not the second seal bore 30, or require a second recess or set of recesses with a smaller dimensioned second seal bore which restricts the inner dimension of the system. Consequently, operators of typical systems can isolate the borehole 58 below the first seal bore 26 only by sealingly engaging the first seal bore 26. In doing so however, elastomeric seals 64, employed in the setting tool 14, such as o-rings for sliding seals of pistons, for example, form a portion of the isolating seal. The sealing requirements for isolating the borehole 58 below the tool 14 are usually more demanding than simply sealing the piston 18 sufficiently to allow actuation of the setting tool 14. As such, typical systems can require more durable and more expensive materials to be used in the elastomeric seals 64. In the instant invention, for example, the elastomeric seals 64 need not form a portion of an isolating seal since the plug 42 can be sealed to the second seal bore 30. Since, in this case, an inside 70 of the tubular 22 and an annular space 74, defined between the borehole 58 and an outer surface 78 of the tubular 22 below the packer 46 are essentially at the same pressure, the elastomeric seals 64 experience no differential pressure thereacross during isolation. The elastomeric seals 64 in the downhole tool seal arrangement 10 disclosed herein has no additional performance requirements beyond what is required to sealingly engage the piston 18 during actuation of the setting tool 14. It should also be noted that when one of the plugs 42 is sealingly engaged with the second seal bore 30 the piston 18 and the elastomeric seals 64 are also isolated from hydrostatic pressure.

Figure 2:
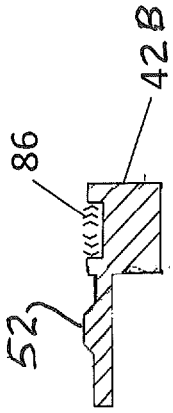
FIG. 2 depicts a cross sectional view of a plug disclosed herein.

Furthermore, a surface 82 of the second seal bore 30 can be dimensioned substantially the same as the surface 53 of the first seal bore 26. In so doing, the plugs 42 that seal to each of the first seal bore 26 and the second seal bore 30 can have similar sealing elements 86 that are dimensioned alike. Additionally, neither of the surfaces 53, 82 will create a restriction to flow through the tubular 22 that is greater than the other. The first plugs 42A then that seal to the first seal bore 26 can differ from the second plugs 42B (FIG. 2) that seal to the second seal bore 30 only in a longitudinal length between the collet 52 and the sealing elements 86.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

The invention claimed is:

1. A downhole tool comprising:

a body being sealingly receptive to a first plug positioned at a first seal bore by a recess in the body and sealingly receptive to a second plug positioned at a second seal bore by the recess in the body; and a piston being movable relative to the body in response to a pressure differential built across the piston, the downhole tool being configured to allow pressure built against the first plug sealed with the body to also build against the piston but to prevent pressure built against the second plug sealed with the body from building against the piston.

2. The downhole tool of claim 1, wherein the tool is a setting tool.

3. The downhole tool of claim 1, wherein the first seal bore is positioned downhole of the second seal bore.

4. The downhole tool of claim 1, wherein a sealing surface of the first seal bore and a sealing surface of the second seal bore employ substantially the same dimensions.

5. The downhole tool of claim 1, wherein the first seal bore and the second seal bore are formed on an inner surface of a tubular.

6. The downhole tool of claim 1, wherein the second seal bore when sealably engaged with a plug isolates the piston from hydrostatic pressure.

7. The downhole tool of claim 1, wherein the recess is an annular recess on an inside of a tubular.

8. The downhole tool of claim 1, wherein the body is a tubular.

9. The downhole tool of claim 8, wherein the tubular includes at least one port therethrough positioned between the first seal bore and the second seal bore.

10. The downhole tool of claim 1, further comprising at least one elastomeric seal disposed at the piston.

11. A method of sealing a downhole tool comprising:

positioning a first plug with a recess of the downhole tool;

sealably engaging a first seal bore of the downhole tool with the first plug;

pressuring up against a piston of the downhole tool with pressure built against the first plug sealed with the body;

removing the first plug from sealing engagement with the downhole tool;

positioning a second plug with the recess;

sealably engaging a second seal bore of the downhole tool with the second plug; and pressuring up against the second plug sealed with the body without pressuring up against the piston.

12. The method of sealing a downhole tool of claim 11, further comprising actuating the downhole tool with the pressure built against the piston.

13. The method of sealing a downhole tool of claim 11, wherein the building pressure against the piston includes porting fluid through an opening in a tubular.

14. The method of sealing a downhole tool of claim 11, wherein the positioning the first plug includes engaging the recess with a collet, dogs or other locking mechanism.

* * * * *